US005711892A

United States Patent [19]

Ramirez

[11] Patent Number: 5,711,892

[45] Date of Patent: Jan. 27, 1998

[54] ICE SCULPTURE MOLD

[76] Inventor: Luis Fernando Ramirez, 125 Union Ave., Center Moriches, N.Y. 11934

[21] Appl. No.: 674,529

[22] Filed: Jul. 2, 1996

[51] Int. Cl.[6] ..... B22C 9/08

[52] U.S. Cl. ..... 249/105; 249/108; 249/160; 249/164; 249/170; 425/DIG. 57

[58] Field of Search ..... 425/DIG. 57; 249/170, 249/171, 108, 105, 164, 160

[56] References Cited

U.S. PATENT DOCUMENTS

| | | | |
|---|---|---|---|
| D. 336,020 | 6/1993 | McHale . | |
| 928,162 | 8/1909 | Stewart | 249/170 |
| 992,830 | 5/1911 | Wheaton | 249/170 |
| 1,906,882 | 5/1933 | Perret | 249/171 |
| 3,344,477 | 10/1967 | Stokis | 249/105 |
| 3,836,308 | 9/1974 | Upright | 249/160 |
| 3,966,166 | 6/1976 | Elliott | 425/DIG. 57 |
| 4,206,899 | 6/1980 | Whitehead . | |
| 4,669,271 | 6/1987 | Noel . | |
| 4,807,844 | 2/1989 | Tu . | |
| 4,905,957 | 3/1990 | Stockwell et al. . | |
| 5,471,853 | 12/1995 | Shih . | |

*Primary Examiner*—Jay H. Woo
*Assistant Examiner*—Iurie A. Schwartz
*Attorney, Agent, or Firm*—Michael I. Kroll

[57] ABSTRACT

An ice sculpture mold having a bottom die half forming a cavity configured to produce a first half portion of a three-dimensional ice sculpture and a top die half with a cavity to produce the second half portion of the ice sculpture. In one embodiment straps are employed to hold the two die halves together during freezing. In another embodiment, a unique leak proof hinge is employed on one side and a latch on the opposite side.

1 Claim, 3 Drawing Sheets

Fig. 3
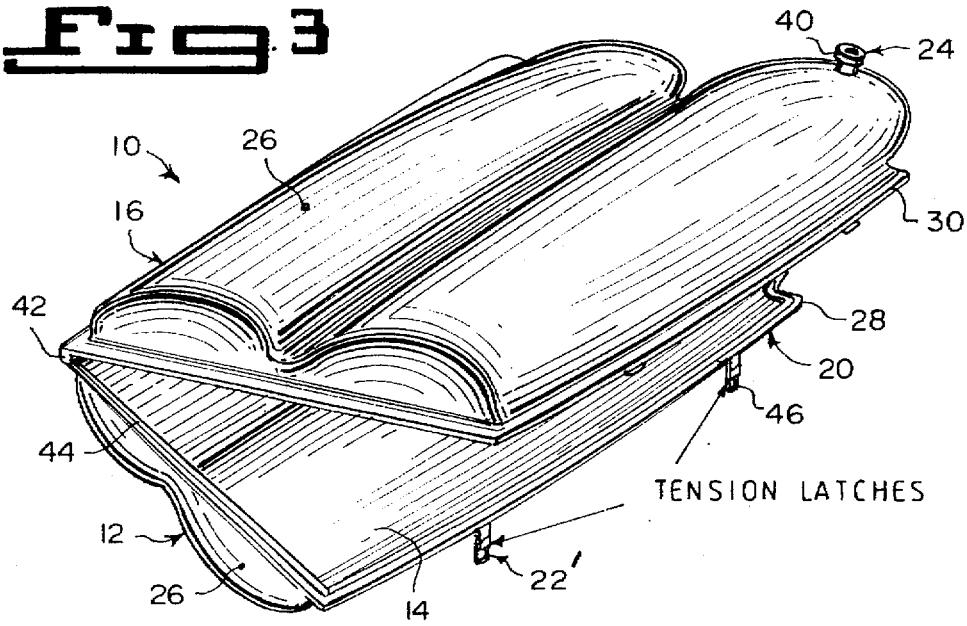
Fig. 4
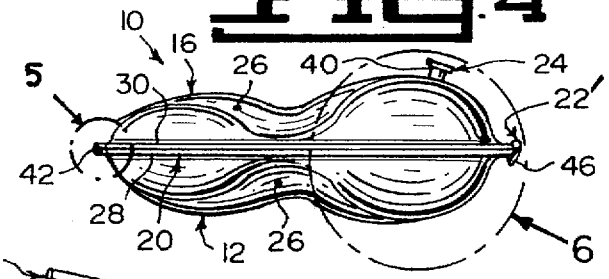
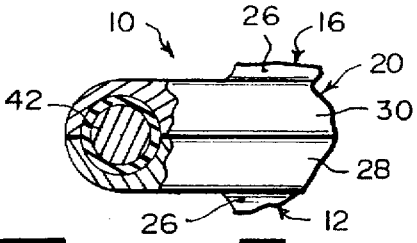
Fig. 5
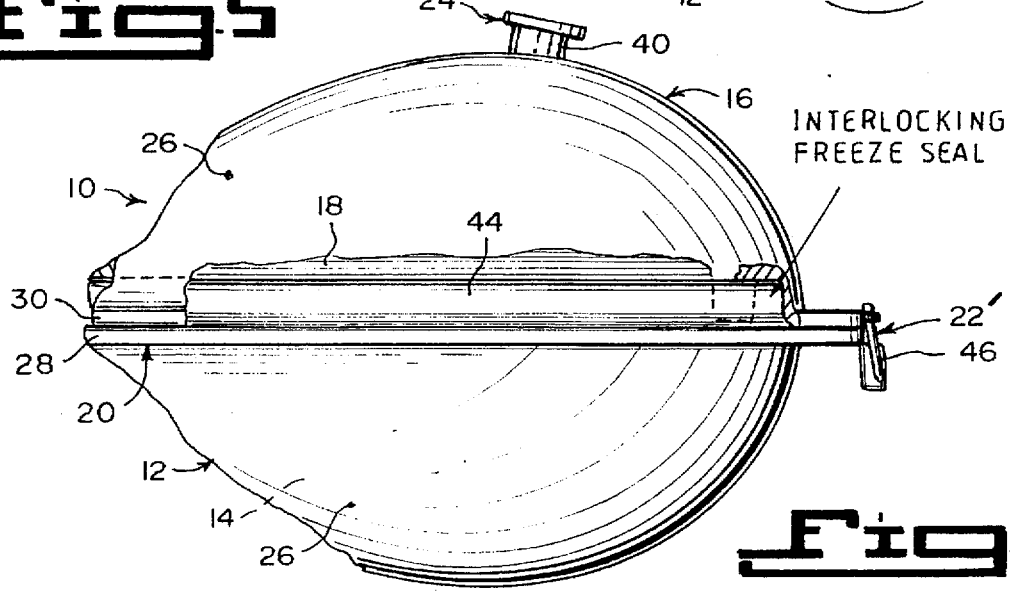
Fig. 6

ICE SCULPTURE MOLD

BACKGROUND OF THE INVENTION

1. Field of the Invention

The instant invention relates generally to ice carving devices and more specifically it relates to an ice sculpture mold.

2. Description of the Prior Art

Numerous ice carving devices have been provided in prior art. For example, U.S. Pat. Nos. 4,206,899 to Whitehead; 4,669,271 to Noel; 4,807,844 to Tu; 4,905,957 to Stockwell et al; 5,471,853 to Shih and Des. 336,020 to McHale all are illustrative of such prior art. While these units may be suitable for the particular purpose to which they address, they would not be as suitable for the purposes of the present invention as heretofore described.

WHITEHEAD, ARTHUR L.

APPARATUS FOR MOLDED ICE SCULPTURE

U.S. Pat. No. 4,206,899

A method and apparatus for forming molded ice sculptures includes a selection of molds fabricated of form retaining, flexible, resilient plastic material. Each mold includes holes in the base thereof through which supporting wires are placed. The mold is inverted, base up, within a box slightly larger than the mold, with the wires impinging on the box and supporting the mold. The mold is filled with water and frozen. Thereafter the mold is removed from the box, the wires removed from the mold and the mold stripped from the frozen sculpture.

NOEL, PAUL

METHOD AND APPARATUS FOR MOLDED ICE SCULPTURE

U.S. Pat. No. 4,669,271

An inexpensive and easily utilized apparatus is provided for producing molded ice structures of improved clarity. The apparatus is comprised of at least two contoured sidewalls adapted to be releasably joined at flat peripheral flanges to define a supported enclosure having an upwardly opening extremity bordered by a horizontally disposed flat rim. A thin flexible water-impermeable envelope, contoured to match the interior configuration of the enclosure, is adapted to be inserted into the enclosure in a manner such that the mouth opening of the envelope is draped across the rim. A thermally initiative cover is adapted to rest upon the sidewalls whereby the mouth of the envelope is held in sandwiched engagement between the cover and rim. In a method of producing ice structures from the apparatus, the assembled apparatus filled with water is placed in a freezing environment. The sidewalls are then separated and the envelope is peeled off the ice structure.

TU, CHEN-HUA

UNITARY MOLD FOR MAKING ICE SCULPTURE

U.S. Pat. No. 4,807,844

A unitary mold for making ice sculpture includes a mold made of elastomer material having an inner cavity concaved downwardly for forming a model of an ice sculpture such as an animal, a building or a person or an article. A perforating bar or needle poking through the mold can be warmed up to slightly melt the ice surrounding the bar or needle for its easy withdrawal from the ice produce to form a through hole in the ice sculpture for decorative, carrying, or water-drainage purposes. An expansion-releasing element, such as a flip-flop member, formed as a part of the mold, serves as a buffer for the expansion of the water during its refrigeration process.

STOCKWELL, AUBREY E. STOCKWELL, DONALD A.

ICE MOLD APPARATUS

U.S. Pat. No. 4,905,957

An ice mold apparatus is set forth wherein a plurality of separable halves including a plurality of securement straps with ends secured to the lower mold half formed with resilient sections to enable expansion of the mold and prevent damage thereto during ice expansion. An overlying funnel is provided with a flange positioned within a housing on the top surface of the upper mold including a self-sealing iris diaphragm wherein the funnel may be directed through the diaphragm to enable complete filling of the mold. The mold interfacing edges are provided with a continuous seal formed within a semi-circular channel in the lower mold and further provided with a series of alignment pins registrable with openings in the upper mold for precise alignment and sealing of the mold halves.

SHIH, WEN-FANG

DEVICE FOR MASS PRODUCTION OF ICE CARVINGS

U.S. Pat. No. 5,471,853

The present invention relates to a mass production device for ice carvings mainly for the automatic production of ice carvings. The invention has a conveyor belt, molding dies, a cooling water tank, a freezing mixture tank, a boring device, an injection device, a temperature rising device and a stripping device. Filtered and cool water is poured into the dies, and the dies delivered into a freezing mixture tank through the conveyor belt for freezing the surface of water in the dies first. A boring hole is used for injection of coloring liquid and decorative objects to be embedded in the frozen carvings. When the dies exit from the freezing mixture tank, they enter a temperature rising device to slightly raise their temperature to facilitate removal of the dies by means of hydraulic cylinder of the stripping device. Ice carvings are thus accomplished through automatic production.

McHALE, MARK A.

MANLIKE ICE MOLD

U.S. Pat. No. Des. 336,020

The ornamental design for a manlike ice mold, as shown and described.

FIG. 3 is a side elevational view thereof;

FIG. 4 is a rear elevational view thereof;

FIG. 5 is a front elevational view thereof;

FIG. 6 is a top plan view thereof; and

FIG. 7 is a bottom view thereof.

Figure 1:
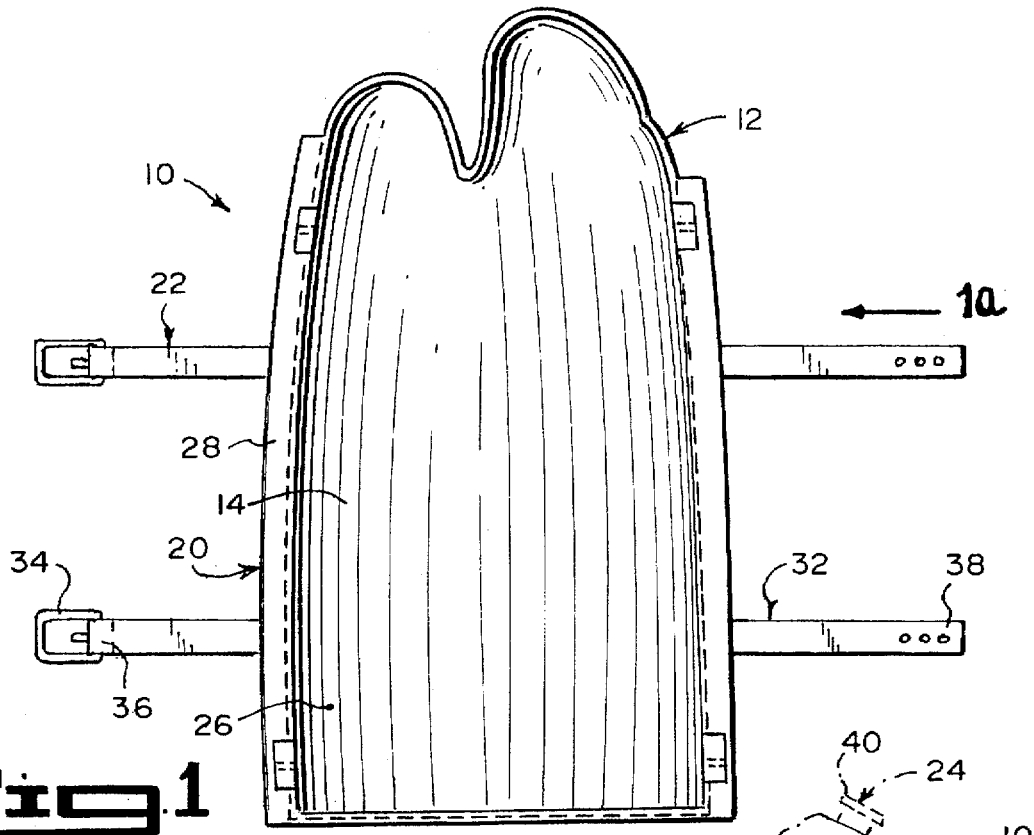
FIG. 1 is an exploded perspective view of the manlike ice mold showing the new design.

None of the preceding patents teach the specific arrangement for strapping the die halves together or the use of the special leak proof hinge employed in the present invention.

SUMMARY OF THE INVENTION

A primary object of the present invention is to provide an ice sculpture mold that will overcome the shortcomings of the prior art devices.

Another object is to provide an ice sculpture mold, in which the production of many ice sculptures can be accomplished without having to hand carve each one individually.

An additional object is to provide an ice sculpture mold, in which an individual will therefore save many hours of manual labor, and not have to pay a specialist a costly salary to produce the ice sculptures.

A further object is to provide an ice sculpture mold that is simple and easy to use.

A still further object is to provide an ice sculpture mold that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a top view of a first embodiment of the instant invention.

Figure 1A:
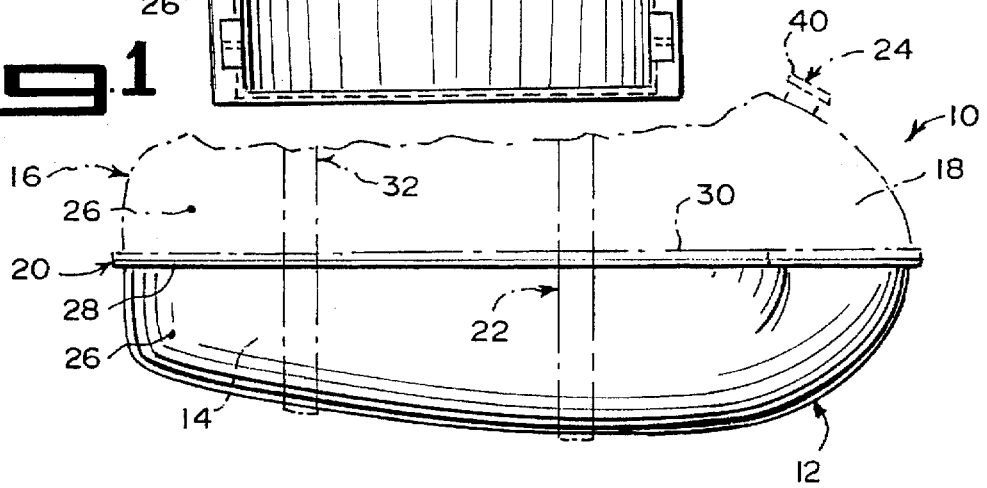

FIG. 1*a* is a side view taken in the direction of arrow 1*a* in FIG. 1.

Figure 2:
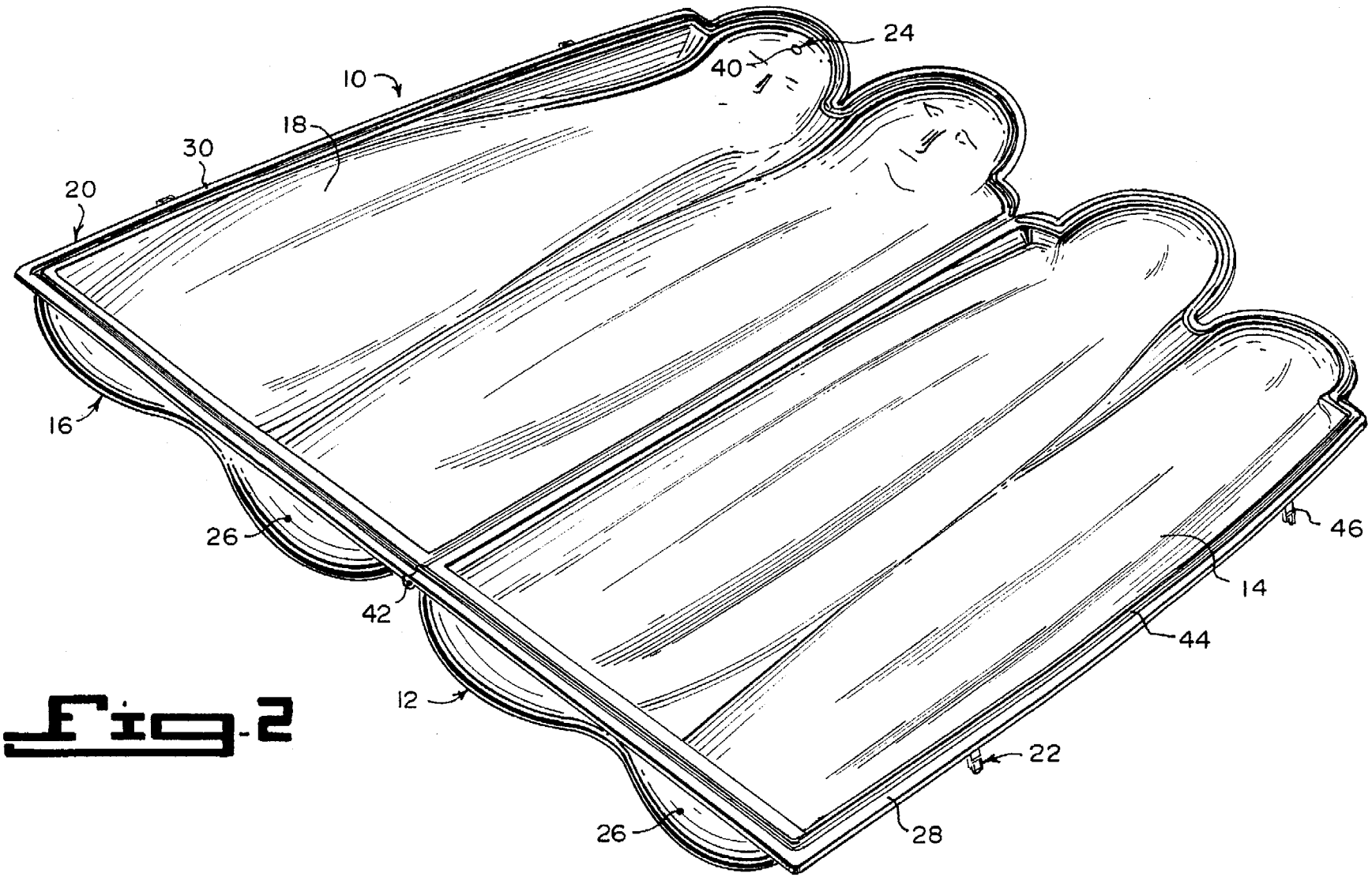
FIG. 2 is a side elevational view thereof.

FIG. 2 is a perspective view of a second embodiment of the instant invention in an opened position.

FIG. 3 is a perspective view of the second embodiment in a partly closed position.

FIG. 4 is an end view of the second embodiment in a closed position.

FIG. 5 is an enlarged end view with parts broken away and in section, as indicated by arrow 5 in FIG. 4, showing the hinge in greater detail.

FIG. 6 is an enlarged end view with parts broken away and in section, as indicated by arrow 6 in FIG. 4, showing the interlocking freeze seal in greater detail.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 6 illustrate an ice sculpture mold 10, comprising a bottom die half 12 having a bottom die cavity 14 configured to produce a first half portion of a three-dimensional ice sculpture. A top die half 16 has a top die cavity 18 configured to produce a second half portion of the three-dimensional ice sculpture. A structure 20 is for sealing the top die half 16 to the bottom die half 12. A facility 22 is for holding the top die half 16 to the bottom die half 12 in a tight and separable manner, so that the sealing structure 20 will prevent leakage therebetween. A component 24 in the top die half 16 is for filling water into the bottom die cavity 14 in the bottom die half 12 and into the top die cavity 18 in the top die half 16. When placed into a very cold environment, the water will freeze into ice to form the three-dimensional ice sculpture.

The bottom die half 12 is fabricated out of a strong durable material 26, which will maintain its shape at a freezing temperature. The top die half 16 is also fabricated out of the strong durable material 26, which will maintain its shape at a freezing temperature.

The sealing structure 20 includes a first flat peripheral flange 28 bordering a side extremity of the bottom die half 12. A second flat peripheral flange 30 is also bordering a side extremity of the top die half 16, whereby the first flange 28 will abut against the second flange 30.

The holding facility 22, as shown in FIGS. 1 and 1*a*, consists of at least one adjustable belt 32 to extend about and secure the top die half 16 to the bottom die half 12. The at least one adjustable belt 32 includes a rigid buckle 34 on a first end 36 to interlock with a second end 38.

The bottom die half 12 and the top die half 16 are of equal size and are each, typically but not limited to, a size being forty three inches in length, twenty five inches in width and twelve inches in depth. The water filling component 24 is a one-way valve 40 affixed through the top die half 16.

As shown in FIGS. 2 through 6, the sealing structure 20 further comprises, a leak-proof hinge 42 integrally built into one side between the first flange 28 and the second flange 30, so that the top die half 16 can close over the bottom die half 12. An interlocking freeze seal 44 is built into other sides between the first flange 28 and the second flange 30. When the top die half 16 is closed over the bottom die half 12, the interlocking freeze seal 44 will automatically engage. The holding facility 22' includes at least one tension latch 46 opposite from the leak-proof hinge 42, to secure the top die half 16 to the bottom die half 12.

OPERATION OF THE INVENTION

To use the ice sculpture mold 10 in FIGS. 1 and 1*a*, the following steps should be taken:

1. Put the top die half 16 over the bottom die half 12, so that the second flange 30 will abut against the first flange 28.
2. Wrap the adjustable belts 32 about the bottom die half 12 and the top die half 16.
3. Interlock the second end 38 with the rigid buckle 34 on each belt 32, so that the belts 32 are tight.
4. Insert water through the one-way pour valve 40, until the bottom die cavity 14 and the top die cavity 18 are full.
5. Place the mold 10 into a very cold environment, so that the water will freeze into ice to form the three-dimensional ice sculpture.
6. Remove the belts 32 and the top die half 16 from the bottom die half 12, to expose the three dimensional ice sculpture.

To use the ice sculpture mold 10 in FIGS. 2 to 6, the following steps should be taken:

1. Close the top die half 16 over the bottom die half 12 via the leak-proof hinge 42, so that the interlocking freeze seal 44 will automatically engage.
2. Lock the tension latches 46 together.
3. Insert water through the one-way pour valve 40, until the bottom die cavity 14 and the top die cavity 18 are full.
4. Place the mold 10 into a very cold environment, so that the water will freeze into ice to form the three-dimensional ice sculpture.
5. Unlock the tension latches 46 and open the top die half 16 from the bottom die half 12, to expose the three dimensional ice sculpture.

LIST OF REFERENCE NUMBERS

| | |
|---|---|
| 10 | ice sculpture mold |
| 12 | bottom die half of 10 |
| 14 | bottom die cavity in 12 |
| 16 | top die half of 10 |
| 18 | top die cavity in 16 |
| 20 | sealing structure in 10 |
| 22 | holding facility in 10 |
| 24 | water filling component in 16 |
| 26 | strong durable material for 12 and 16 |
| 28 | first flat peripheral flange on 12 for 20 |
| 30 | second flat peripheral flange on 16 for 20 |
| 32 | adjustable belt for 22 |
| 34 | rigid buckle on 36 |
| 36 | first end of 32 |
| 38 | second end of 32 |
| 40 | one-way pour valve for 24 |
| 42 | leak-proof hinge of 20 |
| 44 | interlocking freeze seal of 20 |
| 46 | tension latch for 22 |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An ice sculpture mold comprising:

a) a bottom die half with three straight sides having multiple bottom die cavities in a row configured to produce first half portions of three-dimensional ice sculptures;

b) a top die half with three straight sides having top die cavities configured to produce second half portions of the three-dimensional ice sculptures;

c) means for sealing said top die half to said bottom die half comprising a first flange bordering a peripheral extremity of said bottom die half and a second matching flange bordering a peripheral extremity of said top die half, a leak-proof hinge integrally built into one straight side of said mold between said first flange and said second flange permitting said top die half to close with said bottom die half, and an interlocking freeze seal built into and extending uninterruptedly along all the other sides of said mold between said first flange and said second flange for automatically engaging when said top die half is closed over said bottom die half, said freeze seal comprising a raised portion in the flange of said top die half and a groove sized and shaped to receive said raised portion in the flange of said bottom die half, said raised portion fitting into said groove when said mold is closed thereby sealing said mold against leakage of water;

d) means comprising a tension latch opposite from said hinge for holding said top die half to said bottom die half in a tight and separable manner, so that said sealing means will prevent leakage therebetween; and e) means comprising a one-way pour valve affixed in said top die half for filling water into said bottom die cavities in said bottom die half and into said top die cavities in said top die half, so that when placed into a very cold environment the water will freeze into ice to form the three-dimensional ice sculptures.

* * * * *